United States Patent [19]

Phaup

[11] 3,955,764

[45] May 11, 1976

[54] SPRINKLER ADJUSTMENT

[75] Inventor: Charles W. Phaup, Dallas, Tex.

[73] Assignee: Telsco Industries, Garland, Tex.

[22] Filed: June 23, 1975

[21] Appl. No.: 589,051

[52] U.S. Cl. ..... 239/206; 239/242

[51] Int. Cl.[2] ..... B05B 3/16

[58] Field of Search ..... 239/204, 205, 206, 236, 239/240, 242, 241

[56] References Cited

UNITED STATES PATENTS

| | | | |
|---|---|---|---|
| 3,038,666 | 6/1962 | Dudley et al. | 239/242 X |
| 3,771,723 | 11/1973 | Ray | 239/206 |
| 3,785,565 | 1/1974 | Perry et al. | 239/206 |

*Primary Examiner*—John J. Love

*Attorney, Agent, or Firm*—Richards, Harris & Medlock

[57] ABSTRACT

An adjustable nozzle for rotary pop-up sprinklers which allows an operator to accurately position the arc of coverage to any desired location while the pop-up sprinkler is in operation without rotating the entire sprinkler relative to the riser on which it is threaded.

8 Claims, 5 Drawing Figures

SPRINKLER ADJUSTMENT

FIELD OF THE INVENTION

This invention relates generally to nozzles for rotary pop-up sprinklers which will allow hand actuated tool free positioning of the arc of water spray coverage to any desired location while the sprinkler is in operation.

DESCRIPTION OF PRIOR ART

Rotary pop-up lawn sprinklers have long been in both private and large scale commercial use. U.S. Pat. No. 3,526,363 discloses a sprinkler of the rotary pop-up type which has an externally adjustable nozzle. The nozzle is arcuately adjusted while the sprinkler is operating by inserting a screw driver in an externally accessible adjustable screw, loosening the screw, positioning the nozzle and then tightening the screw.

In U.S. Pat. application Ser. No. 500,051, filed Aug. 23, 1974 for SPRINKLER CONTROL and assigned to the assignee of the present invention, now U.S. Pat. No. 3,934,820, a pop-up sprinkler system is disclosed wherein the angle through which the sprinkler cyclically operates and the azimuth of the center of such angle can both readily be selected. Said sprinkler has an outer housing with a nozzle head vertically and rotatably movable in a hole in the outer housing cover. An inner housing is attached to the nozzle head and is slidably received within the outer housing. The inner housing carries the nozzle head and elevates the same in response to the application of pressure inside the outer housing.

Rotary pop-up sprinklers in prior art, however, have not overcome the problems associated with the susceptibility of externally adjustable nozzle controls to vandalism, and the required use of special tools to make such adjustments.

SUMMARY OF THE INVENTION

The present invention is an improvement over such sprinklers, specifically providing for tool free adjustment of azimuth of the operating angle without any observable indicia of the presence of any adjustment means.

The invention is directed to nozzles primarily for oscillating rotary pop-up sprinklers which can be used to accurately position the arc of water spray coverage to any desired location without the use of tools and without externally visible adjustment controls.

More particularly, the invention comprises a nozzle structure having an internal ring of serrated clutch teeth. A nozzle drive tube structure has a mating ring of serrated clutch teeth. The nozzle structure and the drive tube structure are rotatably and slidably supported. Enclosed within the nozzle structure is a nozzle clutch seal.

DESCRIPTION OF THE DRAWINGS

The novel features believed characteristic of the invention are set forth in the appended claims. The invention itself, however, as well as further objects and advantages thereof, will best be understood by reference to the following detailed description of an illustrative embodiment taken in conjunction with the accompanying drawings, in which:

DESCRIPTION OF THE PREFERRED EMBODIMENT

Figure 1:
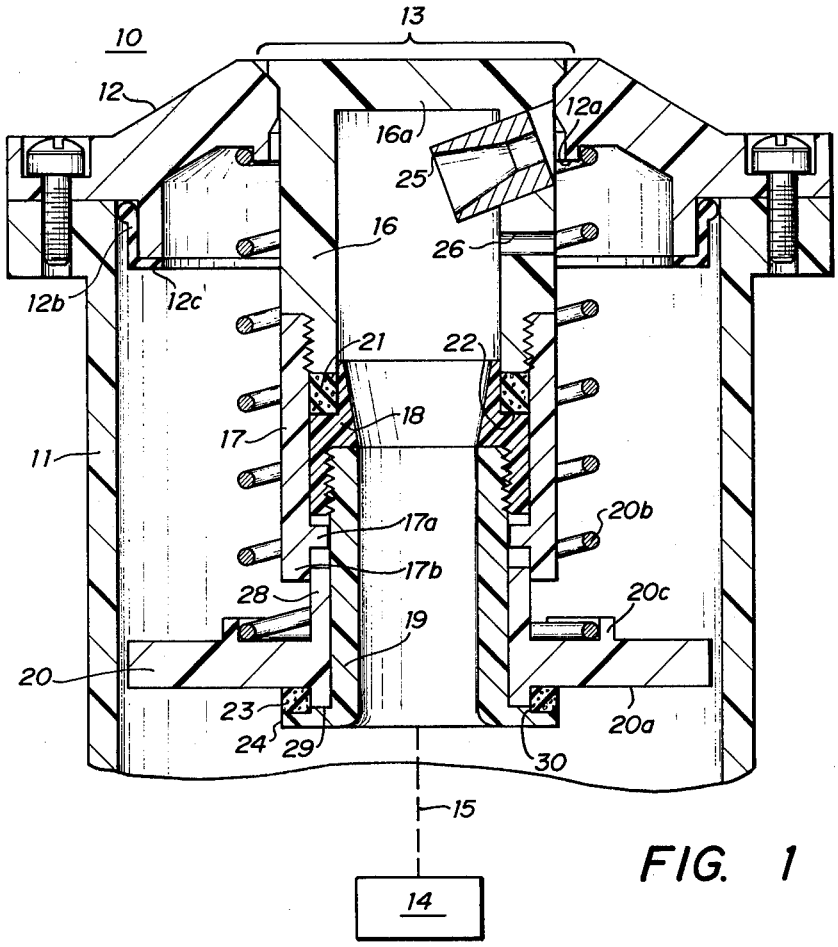
FIG. 1 is a side sectional view of an embodiment of the invention and a typical rotary pop-up sprinkler with the nozzle in a retracted position.

Illustrated in FIG. 1 is an adjustable nozzle for a typical rotary pop-up sprinkler 10 which may be of the type described in said U.S. Pat. No. 3,934,820 (application Ser. No. 500,051). The sprinkler comprises an outer housing 11, a housing cover 12, a motive power source 14 capable of producing flow induced oscillatory rotary motion and a nozzle bearing plate 20. A connecting drive linkage 15 causes oscillation.

Nozzle 13 is made up of several parts and is of cylindrical form. An upper nozzle half 16 is hollow with the upper end thereof closed by a plate **16*a* and is preferably in integral form. A lower nozzle half 17 is interiorly threaded and has the same outside diameter as nozzle half 16 and is threadedly secured to nozzle half 16 at a lower threaded extension thereof. Nozzle half 17 has an inwardly extending rib 17*a* near the lower end thereof, the upper face of which has serrations forming clutch teeth. A nozzle drive clutch 18 is a hollow tube, the lower end of which has serrated teeth which confront the teeth on rib 17*a* and mesh therewith to form a drive connection between drive clutch 18 and the lower nozzle half 17. The nozzle drive clutch 18 threadedly receives in the lower end thereof the upper end of a nozzle drive tube 19. The lower end of drive tube 19 is coupled to the linkage 15 to impart rotation to the nozzle 13. A nozzle clutch seal 21 in the form of a closed cell sponge rubber ring is positioned in an annulus between the lower threaded end of the upper nozzle half 16 and an up facing shoulder on the nozzle drive clutch 18. A washer 22 is positioned between the seal ring 21 and the shoulder on the nozzle drive clutch 18**.

The closure **16*a* of upper half 16 seats in a chambered aperture in the housing cover 12. A compression coil spring 20*b* is mounted outside an annular rib 12*a* on the housing cover 12 and inside an arcuate ring 20*c* on the bearing plate 20 normally to retain the nozzle 13 telescoped inside housing 11**.

The nozzle upper half 16 has a nozzle range tube 25 mounted therein to direct the flow of water from nozzle 13 in the direction of the axis of the opening extending through the range tube 25. A secondary nozzle opening 26 is provided through the wall of the nozzle upper half 16 to cover the near field whereas water ejected through the range tube 25 covers the far field. Bearing plate 20 has an upstanding cylinder 28 extending from the upper surface thereof which telescopes inside the lower end of the lower nozzle half 17 and surrounds the nozzle drive tube 19. A short cylindrical extension 29 extends downwardly from plate 20 and bears against an up facing shoulder 30 near the lower end of drive tube 19.

A rubber gasket **12*b* is mounted on a downwardly extending cylinder component of the housing cover 12 and has a downfacing flat portion 12*c* which serves to contact the upper surface of the plate 20** when the nozzle is extended.

Figure 2:
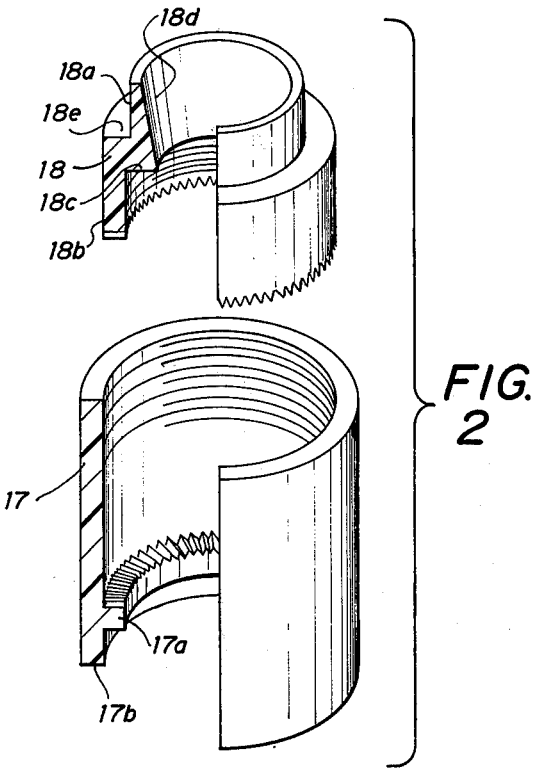
FIG. 2 is a perspective view of the nozzle drive clutch and lower nozzle half meshing arrangement.

FIG. 2 illustrates the clutch structure in greater detail than in FIG. 1. The lower nozzle half 17 has the same outside diameter as the upper nozzle half 16, FIG. 1, with the internal toothed ring 17*a* extending inwardly thereof a short distance above the lower end 17*b*. The upper end of the lower nozzle half 17 is threaded to receive the lower end of the upper nozzle half 16. The nozzle drive clutch member 18 is internally threaded at the lower end thereof to receive the upper end of the nozzle drive tube 19. The lower end of nozzle drive clutch 18 has teeth which match teeth on ring 17*a*.

Figure 3:
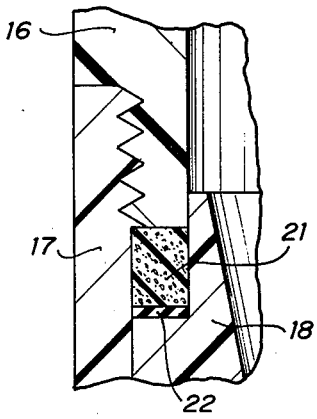
FIG. 3 is an expanded view of the nozzle clutch seal.

FIG. 3 shows the connection between the nozzle upper half 16 and nozzle lower half 17, same being threaded together with the nozzle clutch seal ring 21 positioned to urge the nozzle drive clutch 18 downward. A washer 22 is positioned between the up facing shoulder on clutch 18 and the lower surface of the seal ring 21. As above mentioned, seal ring 21 is preferably made of closed cell sponge rubber and is in the form of a short cylinder. The washer 22 preferably is made of material such as polyethylene or the like which is of low friction character so that there will be negligible forces opposing rotation of nozzle members 16 and 17 relative to a nozzle drive clutch 18 during adjustment of nozzle azimuth.

Nozzle drive clutch 18, best shown in FIG. 2, is a hollow cylinder with its upper end 18*a* smaller in diameter than its lower end 18*b*, and has an integrally formed ring of downwardly extending serrated clutch teeth at lower end 18*b*. Also, the inner walls of lower end 18*b* are internally threaded. The threads terminate at an inwardly extending shoulder 18*c* which joins a conically shaped divergent internal surface 18*d*. The shape of the internal surface of the upper end of drive clutch 18 is of prime importance in the present invention. A divergent conical surface would reduce pressure drop and turbulence in the flowing water while a straight cylindrical surface would create a larger pressure drop and more turbulence. Therefore, if a well defined exit stream and increased throw is a concern, the divergent conical surface would be desired. However, if shorter throw and stream break up is the prime concern, then a straight cylindrical surface would be employed.

A cylindrical nozzle drive tube 19, having an externally threaded portion at its upper end and an outwardly extending rim 24 at its lower end which carries a sealing ring 30, is threaded into the lower end of nozzle drive clutch 18. The upper surface of seal ring 30 is thereby placed in contact with thrust surface 29 of plate 20. Although drive tube 19 is fixedly secured to drive clutch 18, the drive tube remains in rotatable relation with the inner walls of bearing 28. In addition, the outer walls of bearing 28 are in rotatable relation with the downward extending inner walls of the annular recess 17*b* of lower nozzle 17. Thus, a rotation of drive tube 19 causes both the drive tube and drive clutch 18 to rotate with respect to bearing 28.

A nozzle clutch seal 21 and a nozzle clutch washer 22 are contained within the hollow cylindrical space formed by the external surface of the smaller diameter portion of drive clutch 18, the adjoining outwardly extending rim 18*e* on drive clutch 18, the inside surface of lower nozzle 17 and the lower surface of upper nozzle 16.

Clutch seal 21 is preferably an elastomeric material, and in the preferred embodiment is a closed cell sponge rubber. The closed cell sponge provides an excellent combination of elasticity and sealing capacity. The word "sealing" here means sealing out sand and debris and not necessarily sealing out water. Clutch washer 22 in the preferred embodiment is a thin polyethylene plastic. The function that these two members perform will be explained later.

Drive tube seal 23 is a flat circular washer that is confined between a lower horizontal surface 20*a* of bearing plate 20, the vertical surface of the bearing 28 extending below plate 20, and the upper horizontal surface of ring 30. The purpose of seal 23 is to filter out sand and debris in the water that might leak through on to the thrust surface 29. In the preferred embodiment, seal 23 is a felt material.

Operation typical of a rotary pop-up sprinkler involves housing 11, the lower end of which is threaded onto a water supply riser. Slidably received nozzle 13 responds to motive power source attached to bearing plate 20. As pressurized water is applied to the riser, the motive power source 14, connecting drive 15, and nozzle 13 all rise together until the plate 20 seats on an elastomeric seal 12*c* thereby forcing water to flow through the hollow nozzle 13. Or the connecting drive 15 from the motive power source has a slidable connection with nozzle 13, and as pressurized water is applied to the riser only the nozzle will rise until plate 20 seats on seal 12*c* to force water to flow through the hollow nozzle 13.

With the motive power source 14 attached to plate 20, in the absence of pressurized water supplied to the riser the nozzle 13 will assume the retracted position of FIG. 1. In this state, nozzle clutch seal 21, being slightly compressed by threading upper nozzle 16 into lower nozzle 17, creates a downward spring like force on clutch washer 22 which transmits this force to the horizontal surface 18*e* of nozzle clutch 18. This downward force holds the downward extending serrated clutch teeth on clutch 18 in meshing engagement with the upward extending serrated clutch teeth on lower nozzle 17. Thus a drive connection is established between the motive power source 14 and the upper nozzle 16 via the connecting drive 15 from the motive power source which rotates drive tube 19 that is threadedly secured to drive clutch 18, through the engaged clutch teeth on drive clutch 18 and lower nozzle 17, and finally through the threaded connection between lower nozzle 17 and the upper nozzle 16. The threaded connections suffer a very negligible if any frictional torque which might tend to loosen them while operating, because all frictional torque resisting rotation of the nozzle 13 takes place at thrust surface 29.

Figure 4:
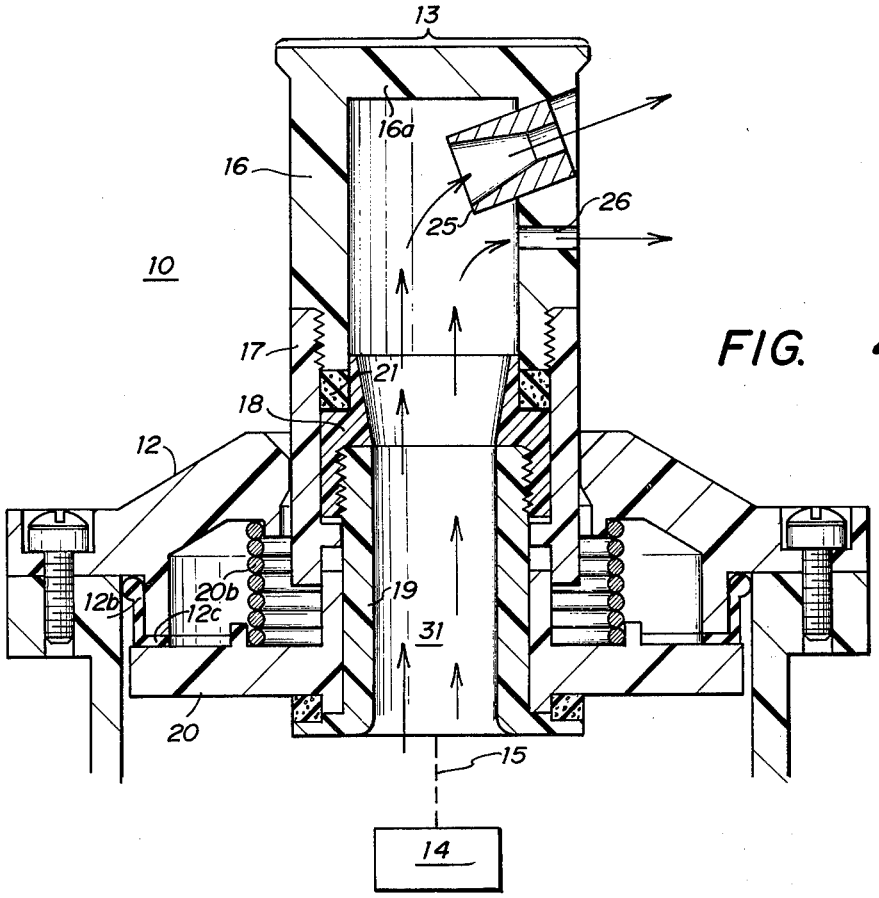
FIG. 4 is a side sectional view of an embodiment of the invention and a typical rotary pop-up sprinkler with the nozzle in its extreme elevated position.

As pressurized water is supplied to the riser, it flows up through housing 11, FIG. 4, into the hollow bore 31 of drive tube 19, out through the conical divergent portion of drive clutch 18, into the hollow bore of upper nozzle 16 where it is then directed outward as a spray through range tube 25 and secondary opening 26. The pressurized water creates an upward force on the inner surface of the plate 16*a* which causes the nozzle 13, plate 20 and attached motive power source 14 to rise until the plate 20 seats on seal 12*c*. In this position, FIG. 4, the upward force of the pressurized water on plate 16*a* creates an additional force (additional to the spring force of clutch seal 21) tending to hold the clutch teeth on drive clutch 18 and lower nozzle 17 firmly enmeshed so that the bi-directional rotational forces produced by source 14 are transmitted to the upper nozzle 16 via the drive connection described above.

An operator often installs a part circle sprinkler on a supply riser such that a pressure tight water seal is obtained between the riser threads and the threads on the lower end of housing 11, and discovers that the arc covered by the part circle sprinkler is shifted to one side of the desired location so far that he cannot rotate the housing 11 relative to the riser to correct the shift without affecting the water tight seal between the housing 11 and riser.

Figure 5:
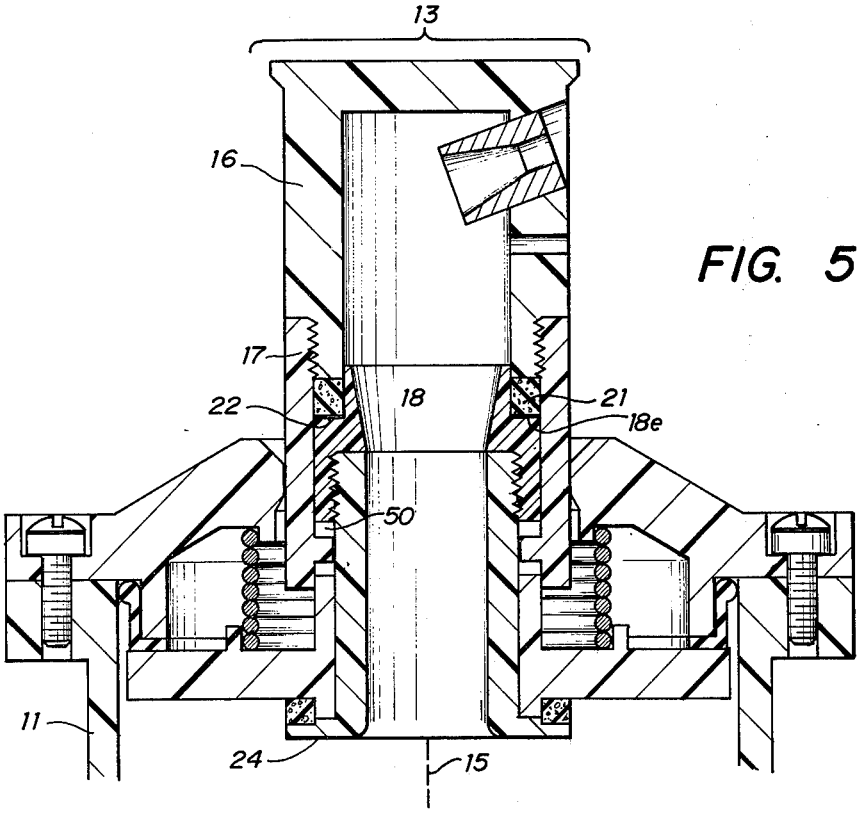
FIG. 5 is a view of FIG. 4 with the nozzle depressed for adjustment of the spray angle.

With the present invention, FIG. 5, all the operator has to do is apply a downward force to the top of upper nozzle 16 with his hand so that there is a space 50 between the teeth on the nozzle lower half 17 and on the nozzle drive clutch 18, turn the upper nozzle 16/lower nozzle 17 assembly the desired amount and then release the downward force on upper nozzle 16. Water pressure plus the force of seal ring 21 will then force the upper nozzle 16/lower nozzle 17 assembly upward to remesh the clutch teeth on nozzle clutch 18 and lower nozzle 17 and the sprinkler will continue its normal mode of operation.

More particularly, the downward force on upper nozzle 16 is transmitted to the lower nozzle 17 through the threaded connection. The pressurized water creates an upward force on rim 24 sufficient to overcome the downward force created by the compression of nozzle seal 21. Therefore, the engaged clutch teeth separate breaking the drive connection and allowing the upper nozzle 16/lower nozzle 17 assembly to rotate relative to the drive clutch 18/drive tube 19 assembly. Nozzle clutch washer 22 provides a low friction interface between the clutch seal 21 and outwardly extending rim 18*e* on nozzle drive clutch 18 so that the upper nozzle 16/lower nozzle 17 assembly can be easily rotated relative to the drive clutch 18/drive tube 19 assembly.

The present invention eliminates the need for special adjusting tools, and hides the fact that the nozzle can be adjusted from the intermeddler who tampers with easily accessible controls.

Having described the invention in connection with certain specific embodiments thereof, it is to be understood that further modifications may now suggest themselves to those skilled in the art and it is intended to cover such modifications as fall within the scope of the appended claims.

What is claimed is:

1. An adjustable nozzle for a pop-up sprinkler head having a cylindrical cover plate aperture through which the nozzle is to operate, which comprises:

a. a hollow cylinder structure positioned in said aperture having a closed upper end and structure forming flow orifices through the side wall near said closed upper end for directing spray from said nozzle, b. a hollow nozzle drive tube structure positioned coaxially with and below said cylinder, c. normally enmeshed up facing and down facing clutch teeth carried by said cylinder and said drive tube, respectively, and d. resilient means positioned between confronting portions of said cylinder and said drive tube to permit downward movement of said cylinder relative to said drive tube to disengage said teeth and permit rotation of said cylinder relative to said drive tube for adjustment of the spray axis.

2. The combination set forth in claim 1 in which said resilient means comprises a closed cell compressible ring with a low friction coefficient layer between one surface of said ring and one of said cylinder structure and said tube structure.

3. The combination set forth in claim 1 in which said cylinder has an annular exterior rib of diameter greater than the diameter of said aperture to stop the descent of said cylinder through said aperture.

4. The combination set forth in claim 1 in which the downstream internal surface of said drive tube is conically divergent.

5. The combination set forth in claim 1 in which the downstream internal surface of said drive tube is cylindrical.

6. An adjustable nozzle for a pop-up sprinkler head having a cylindrical cover plate aperture through which the nozzle is to operate, which comprises:

a. a hollow cylinder positioned in said aperture having a closed upper end and structure defining flow orifices through the side wall near said closed upper end for directing spray from said nozzle, b. a hollow nozzle drive tube positioned coaxially with and below said cylinder, c. a hollow sleeve secured to the upper end of said drive tube and presenting an upper gasket shoulder facing the bottom of said cylinder and a down facing toothed shoulder below said gasket shoulder, d. a downward extending clutch member secured to the lower end of said cylinder and having an up facing shoulder having teeth enmeshed with the teeth on said down facing shoulder, and e. a compressible gasket on said gasket shoulder normally to maintain said teeth enmeshed while permitting depression of said cylinder relative to said drive tube to disengage said teeth to permit rotation of said cylinder relative to said drive tube for adjustment of the spray axis.

7. The combination set forth in claim 6 in which the downstream internal surface of said hollow sleeve is conically divergent.

8. The combination set forth in claim 6 in which the downstream internal surface of said hollow sleeve is cylindrical.

* * * * *